US005929888A

United States Patent [19]

Kawamura

[11] Patent Number: 5,929,888

[45] Date of Patent: Jul. 27, 1999

[54] RECORDING SHEET CLEANING APPARATUS FOR THERMAL PRINTER

[75] Inventor: Katsumi Kawamura, Tokyo, Japan

[73] Assignee: Asahi Kogaku Kogyo Kabushiki Kaisha, Tokyo, Japan

[21] Appl. No.: 08/824,730

[22] Filed: Mar. 26, 1997

[30] Foreign Application Priority Data

Mar. 28, 1996 [JP] Japan ..... 8-099450

[51] Int. Cl.[6] ..... B41F 35/00

[52] U.S. Cl. ..... 347/171; 347/222

[58] Field of Search ..... 347/171, 222; 400/719; 101/423

[56] References Cited

U.S. PATENT DOCUMENTS 5,315,359 5/1994 Nishikawa ..... 355/315
5,370,049 12/1994 Oshine et al. ..... 101/288
5,421,261 6/1995 Stempien ..... 101/423
5,638,104 6/1997 Suzuki et al. ..... 347/171

FOREIGN PATENT DOCUMENTS 0622242 11/1994 European Pat. Off. ..... B41J 29/17

*Primary Examiner*—N. Le
*Assistant Examiner*—Anh T. N. Vo
*Attorney, Agent, or Firm*—Greenblum & Bernstein P.L.C.

[57] ABSTRACT

A recording sheet cleaning apparatus is mounted on a printer having a thermal head and arranged to feed a recording sheet along a sheet feeding path. The recording sheet cleaning apparatus includes a wiping member located upstream of the thermal head along the sheet feeding path. The wiping member is located on the same side as the thermal head with respect to the sheet feeding path. The recording sheet introduced into the printer contacts with the wiping member, so that the printing surface of the recording sheet (the surface facing the thermal head) is wiped by the wiping member before printing.

8 Claims, 7 Drawing Sheets

RECORDING SHEET CLEANING APPARATUS FOR THERMAL PRINTER

BACKGROUND OF THE INVENTION

The present invention relates to a thermal printer, and more particularly to a recording sheet cleaning apparatus for a thermal printer.

A thermal printer, such as a thermal line printer, forms an image on a heat-sensitive recording sheet such as heat-sensitive paper, using a thermal head having printing elements (heat generating elements). Generally, the recording sheet is pressed to the thermal head by a platen roller to obtain sufficient heat transmission from the printing elements to the recording sheet.

A problem arises in such a thermal printer in that, if debris has adhered to a printing surface of the recording sheet (i.e., the surface at the thermal head side) prior to the insertion of the recording sheet into the thermal printer the debris may interfere with the printing elements of the thermal head. That is, debris may interfere with the heat transmission from the printing elements to the recording sheet, which creates unintentional non-printed portion.

If where a standard heat-sensitive paper is used as the recording sheet, the paper may deform when pressed between a platen roller and the thermal head, so as to wrap around debris. Since debris is generally below 50 $\mu$m, there are only a few cases which results in large non-printing portion that can be recognized with naked eye.

However, when a thermal OHP (over head projector) sheet is used as the recording sheet, since the thermal OHP sheet has a high rigidity, it and does not deform to wrap around debris. Therefore, the area affected by the presence of debris is larger, because heat is prevented from transmitting from the surrounding printing elements. Thus, the presence of debris causes a larger non-printing portion that can be recognized with the naked eye.

In a printer where a pressing force for pressing the recording sheet to the thermal head is relatively small, the above-mentioned non-printed portion becomes more significant. For example, with regard to thermal OHP sheets, debris below 50 $\mu$m may cause a wrinkle-shaped non-printed portion having a width of approximately 1 mm (in the feeding direction of the thermal OHP sheet.).

SUMMARY OF THE INVENTION

It is therefore an object of the present invention to provide a recording sheet cleaning apparatus for cleaning a printing surface of a recording sheet before printing.

According to one aspect of the present invention, a recording sheet cleaning apparatus is mounted to a thermal printer having an inlet opening, a thermal head and a sheet feeding path for feeding recording sheets past the inlet opening and the thermal head. The recording sheet cleaning apparatus includes a wiping member. A first guide member which supports the wiping member in such a manner that the wiping member is upstream of the thermal head along the sheet feeding path. The wiping member and the thermal head are at the same side with respect to the sheet feeding path. A second guide member biases, the recording sheet against the wiping member, so that the recording sheet is in contact with the wiping member.

As constructed above, the printing surface of the recording sheet (the surface facing the thermal head) is wiped by the wiping member when the paper is fed by the printer. Therefore, the printing surface is cleaned before the thermal head forms an image on the printing surface of the recording sheet.

The thermal head can be a thermal line head including an array of heat generating elements. In this case, it is preferred that the wiping member has a length equivalent to the array. Further, the wiping member can be made of polyurethane foam so that the recording sheet can smoothly slide on the wiping member.

Preferably, the, first and second guide members are made of two sheet members facing each other, extending along the sheet feeding path. Further, the recording sheet cleaning apparatus includes a base member for supporting the first and second guide members. The base member can be placed on a housing of the printer. The first and second guide members can be integrally formed with the base member.

In a preferred embodiment, the first and second guide members extend apart from said inlet opening and outside of said printer. Optionally, the recording sheet cleaning apparatus includes a third guide member which extends into the interior of the printer through the inlet opening in such a manner that the third guide member and the thermal head are at the same side with respect to the sheet feeding path. With this, debris on the inlet opening and its circumference is covered by the third guide member and prevented from transferring to the printing surface of the recording sheet.

Further optionally, the recording sheet cleaning apparatus includes a mounting arrangement for detachably mounting the first and second guide members and the base members to the printer. The mounting arrangement includes a frame to which the base member is fixed and a clamp member engagable with a housing of the printer. As constructed above, it is possible to use the printer without recording sheet cleaning apparatus, for example, when the standard heat-sensitive paper is used as the recording sheet. Preferably, the first guide member has a charge removing brush between the wiping member and the inlet opening along the sheet feeding path. With this, the undesired charge caused by the friction between the recording sheet and the wiping member can be removed.

In another preferred embodiment, the first and second guide members extend into the interior of the printer through the inlet opening, along the sheet feeding path. Since the wiping member is positioned in the printer, there is less chance that debris in the air will adhere to the recording sheet after the wiping is completed. In this case, the charge removing brush is provided between the wiping member and the thermal head.

Conveniently, the first guide member has an engaging member which is engageable with the inlet opening of the printer from inside of the printer. The engagement between the engaging member and the inlet opening can be disengaged by deforming the first guide member. As constructed above, the entire size of the printer (with the recording sheet cleaning apparatus mounted) is not increased. Further, the additional mounting arrangement is not necessary.

DETAILED DESCRIPTION OF THE PREFERRED EMBODIMENTS

Figure 1:
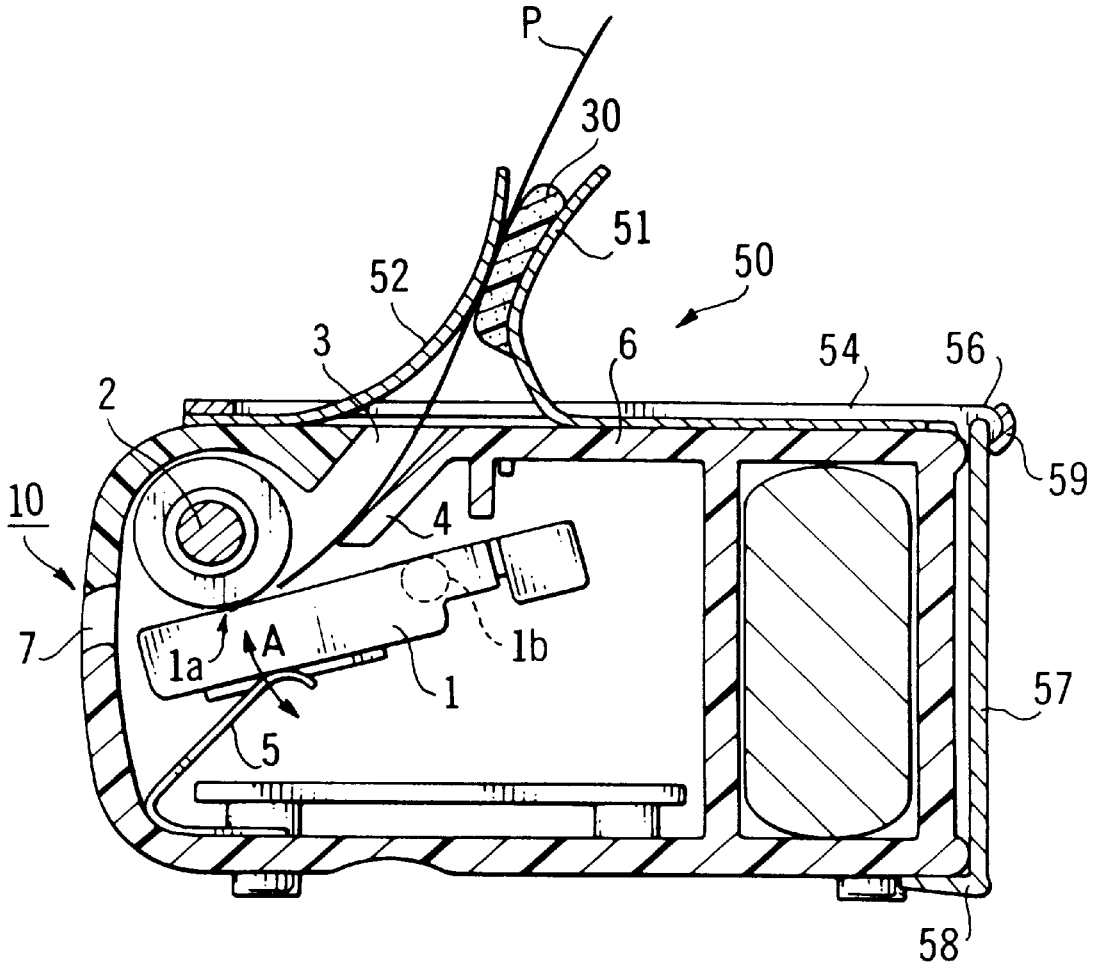
FIG. 1 is a sectional view showing a thermal printer and a recording sheet cleaning apparatus according to a first embodiment of the invention.

FIG. 1 is a sectional view showing a thermal line printer 10 and a recording sheet cleaning apparatus 50 according to the first embodiment of the invention.

The thermal printer 10 is designed to print on a recording sheet P such as heat-sensitive paper or the like. The thermal printer 10 includes a casing 6, a thermal head 1, and a platen roller 2 provided opposite the thermal head 1. The thermal head 1 includes an array of printing elements 1*a* (heat generating elements), the array having a length substantially equivalent to the width of a single page. The thermal head 1 is able to print information on the recording sheet P to a full line of a page, without moving the thermal head 1.

The casing 6 has an inlet slot 3 on the top thereof and an outlet slot 7 on the side thereof. The thermal printer 10 is arranged to define a recording sheet feeding path such that the recording sheet P passes through the inlet slot 3, between the thermal head 1 and the platen roller 2, and out of the outlet slot 7. The casing 6 also includes a slope 4 which guides the recording sheet P from the inlet slot 3 to the thermal head 1.

Further, the thermal head 1 is mounted on a pivot 1*b* (shown with a dashed line) such that the thermal head 1 is swingable in the direction of the arrow A. During a printing operation, the thermal head 1 is pressed upward against the platen roller 2 by a spring 5 provided at the lower side of the thermal head 1.

Thus, in a printing operation, a user inserts a recording sheet P through the inlet slot 3. The recording sheet P is guided by the slope 4 until a leading edge of the recording sheet P comes into contact with the thermal head 1 and the platen roller 2. The thermal printer 10 receives image data from a computer (not shown) and begins rotating the platen roller 2. As the recording sheet P moves forward due to the rotation of the platen roller 2, the thermal head 1 starts heating the resistive elements 1*a* according to the image data and an image is formed on the recording sheet P. After passing the thermal head 1, the recording sheet P is sent through the outlet slot 7.

A recording sheet cleaning apparatus 50 is mounting to the top surface of the printer 10. The recording sheet cleaning apparatus 50 is provided with a first and second guide members 51 and 52. The first and second guide members 51 and 52 are formed of a flexible sheet members and face each other on the upper section of the printer 10 above the inlet slot 3 to form a transfer path of the recording sheet P into the inlet slot 3. In particular, the first guide member 51 extends from the rear side (the right hand side of FIG. 1) of the upper surface of the printer 10 toward the inlet slot 3 and is bent upward in the vicinity of the inlet slot 3. The second guide member 52 extends from the front side (the left hand side of FIG. 1) of the upper surface of the printer 10 toward the inlet slot 3 and is bent upward in the vicinity of the inlet slot 3 such that the second guide member 52 faces the first guide member 51.

A wiping member 30 is provided on an upper part of the first guide member 51 such that the wiping member 30 is in contact with the second guide member 52. The wiping member 30 is pressed by the elasticity of the bent first and second guide member 51 and 52 by a predetermined pressing force. The pressing force is set so as to allow the recording sheet P to be smoothly fed through between the second guide member 52 and the wiping member. In this way, the wiping member 30 is in contact with the printing surface (the surface facing the thermal head) of the recording sheet P and wipes the printing surface of the recording sheet P.

Preferably, the wiping member 30 is formed of a material having a predetermined surface smoothness and flexibility. In this embodiment, the material is sponge-like polyurethane foam. Also, the wiping member 30 must be sufficiently soft in order to wipe debris off the printing surface of the recording sheet P. The wiping member 30 is preferably made of polyurethane foam having more than 30 pores per 25 $mm^3$.

In the prior art, if debris adheres to the printing surface (the side facing the thermal head 1) of the recording sheet P, and if the debris enters between the printing elements 1*a* and the recording sheet P, it interferes with the heat transmission from the thermal head 1 to the recording sheet P. This is particularly a problem when thermal OHP (overhead printer) sheets are used as the recording sheet P.

However, as constructed above, the recording sheet P and the wiping member 30 are pressed together by the elasticity of the first and second guide members 51 and 52 as the recording sheet P is fed through between the wiping member 30 and the second guide member 52. That is, the printing surface of the recording sheet P and the wiping member 30 are pushed together with sufficient force to wipe debris off of the recording sheet P. Thus, debris that has adhered to the printing surface of the recording sheet P is prevented from entering the printer 10.

Figure 2:
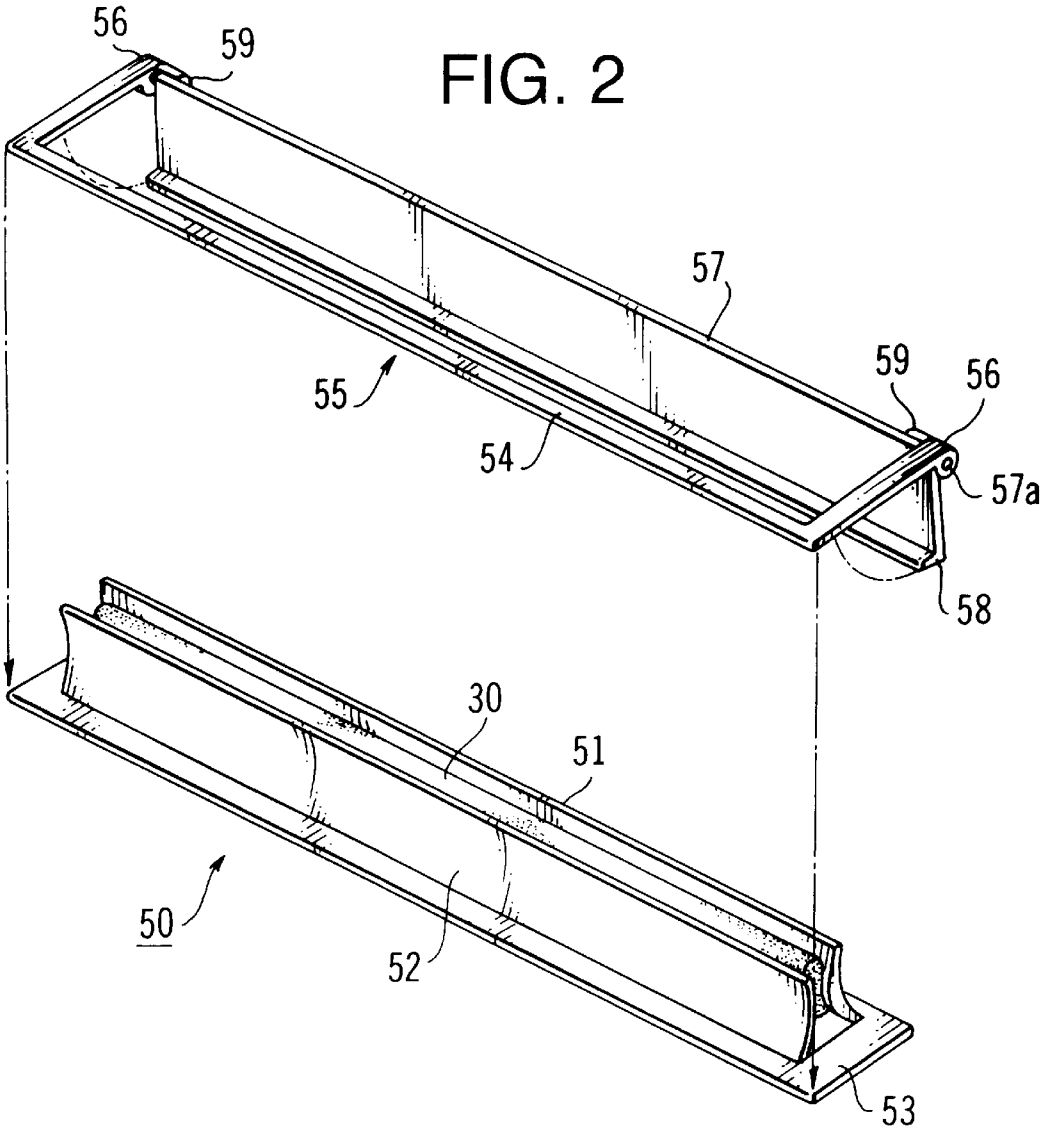
FIG. 2 is a perspective view of the recording sheet cleaning apparatus shown in FIG. 1.
Figure 3:
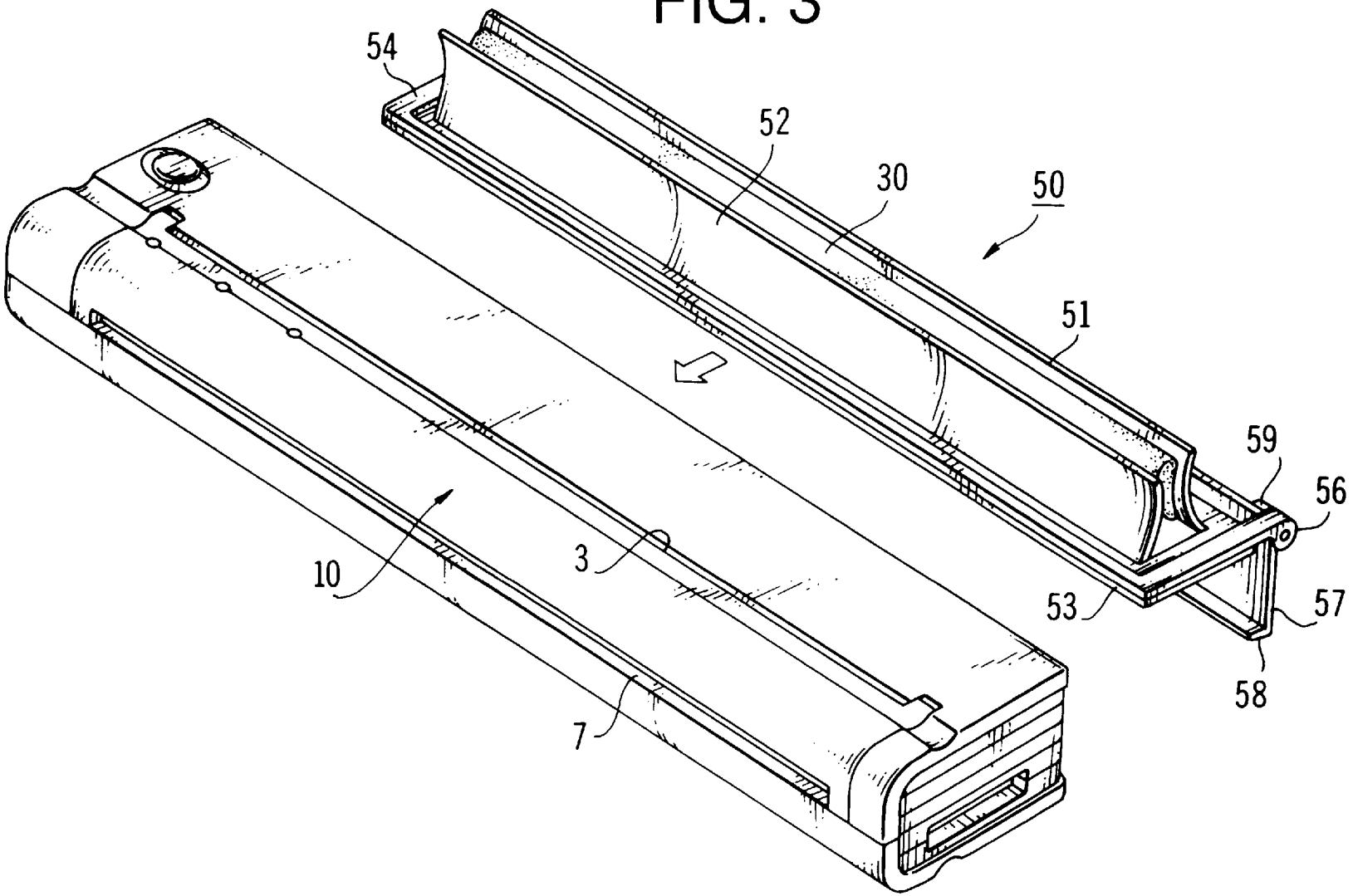
FIG. 3 is an exploded perspective view showing the mounting of the recording sheet cleaning apparatus on the thermal printer.

The arrangement for mounting the first and second guide members 51 and 52 to the printer 10 is descried with respect to the FIGS. 2 and 3.

FIG. 2 is a perspective view showing the recording sheet cleaning apparatus 50. As shown in FIG. 2, the first and second guide members 51 and 52 are formed integrally with a base sheet 53. The base sheet 53 is a rectangular sheet from which each of the first and second guide members 51 and 52 extend in an upward curve, oppositely oriented to each other.

The recording sheet cleaning apparatus 50 further includes a mounting section 55 by which the rectangular base sheet 53 is detachably mounted on the printer 10. The mounting section 55 includes a mounting frame 54 and a clamping member 57. The mounting frame 54 is formed as a three-sided rectangular frame that fits over the top of the base sheet 53 allowing the first and second guide members 51 and 52 to pass through the space defined by the three arms thereof. The periphery of the mounting frame 54 is formed substantially the same as the periphery of the base sheet 53. The mounting frame 54 is provided with, at the ends of the short sides thereof, a pair of hinge sockets 56 which engaged a pair of hinge pins 57*a* provided on the clamping member 57. Thus, the clamping member 57 is rotatable with respect to the mounting frame 54 about the hinge pins 57*a*.

The hinge sockets 56 are each provided with a stopper member 59 arranged so that the mounting plate 57 does not rotate more than 90 degrees from the mounting frame 54. Thus, the clamping member 57 may be folded together with the mounting frame 54, for example during non-use, and then opened to 90 degrees relative to the mounting frame 54 as shown with a phantom line in FIG. 2 for attachment to the printer 10.

Furthermore, the clamping member 57 is further provided with a hook section 58 along an edge which is opposite the hinge pins 57*a*. The hook section 58 extends perpendicular to the clamping member 57 such that the hook section 58 slides under the lower portion of the printer 10 during attachment --of the mounting section 55 on the printer 10 as described below.

To attach the recording sheet cleaning apparatus 50 to the printer 10, the mounting section 55 is first connected to the base sheet 53 such that the three sides of the mounting frame 54 are adhered to the upper surface of the base sheet 53 around the periphery thereof, which makes the mounting section 55 and the base sheet 53 one unit. Next, as shown by the arrow in FIG. 3, the recording sheet cleaning apparatus 50 is slid from rearward of the printer 10, such that the base sheet 53 slides along the upper surface of the-printer 10 and the hook section 58 is hooked around the lower side of the printer 10 (See FIG. 1). Thus, the recording sheet cleaning apparatus 50 is easily attached to the printer 10. Conversely, the removal (detachment) of the recording sheet cleaning apparatus 50 is done by simply sliding the recording sheet cleaning apparatus 50 toward the rear of the printer 10.

Thus, the recording sheet cleaning apparatus 50 according to the present embodiment can be easily attached and detached as required to prevent debris that has adhered to the printing surface of a recording sheet P from entering the printer 10.

Figure 4:
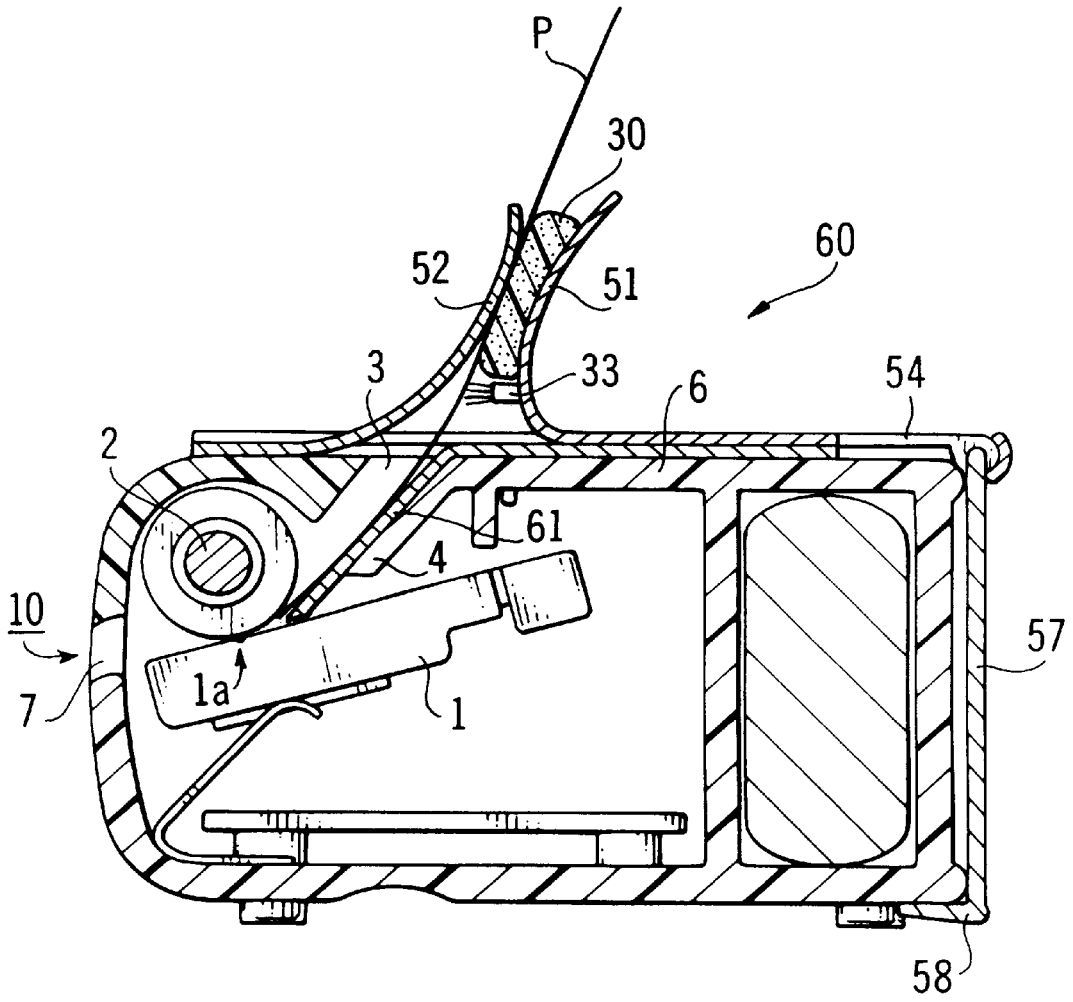
FIG. 4 is a sectional view of a thermal printer and a recording sheet cleaning apparatus according to a second embodiment of the invention.

FIG. 4 shows the printer 10 and a recording sheet cleaning apparatus 60 according to the second embodiment. In this and the following embodiments, elements that are substantially the same as those described in the first embodiment are denoted by the same reference numbers. The recording sheet cleaning apparatus 60 further includes a third guide member 61 that extends into the inlet slot 3 and a charge removing brush 33 to eliminate any undesirable charge formed on the recording sheet P due to contact with the wiping member 30.

The third guide member 61 is formed integrally with the base sheet 53, and extends from the rear (the right side in the drawing) of the printer 10 and bends into the inlet slot 3 to follow the slope 4 and extend to just prior to the thermal head 1. If the slope 4 has debris which has attached before mounting the apparatus to the printer, debris may transferred to the printing surface of the recording sheet. However, by providing the third guide member 61 which covers the slope 4, the recording sheet P is further protected from having debris adhere to the printing surface thereof.

Furthermore, the charge removing brush 33 is provided on the first guide member 51 along the recording sheet feed path from the wiping member 30 and is attached to a ground terminal (not shown) in the printer 10. The charge removing brush 33 contacts the recording sheet P to remove any undesirable charge caused by friction with the wiping member 30 so that the recording sheet P does not attract dust and dirt inside the printer 10.

Figure 5:
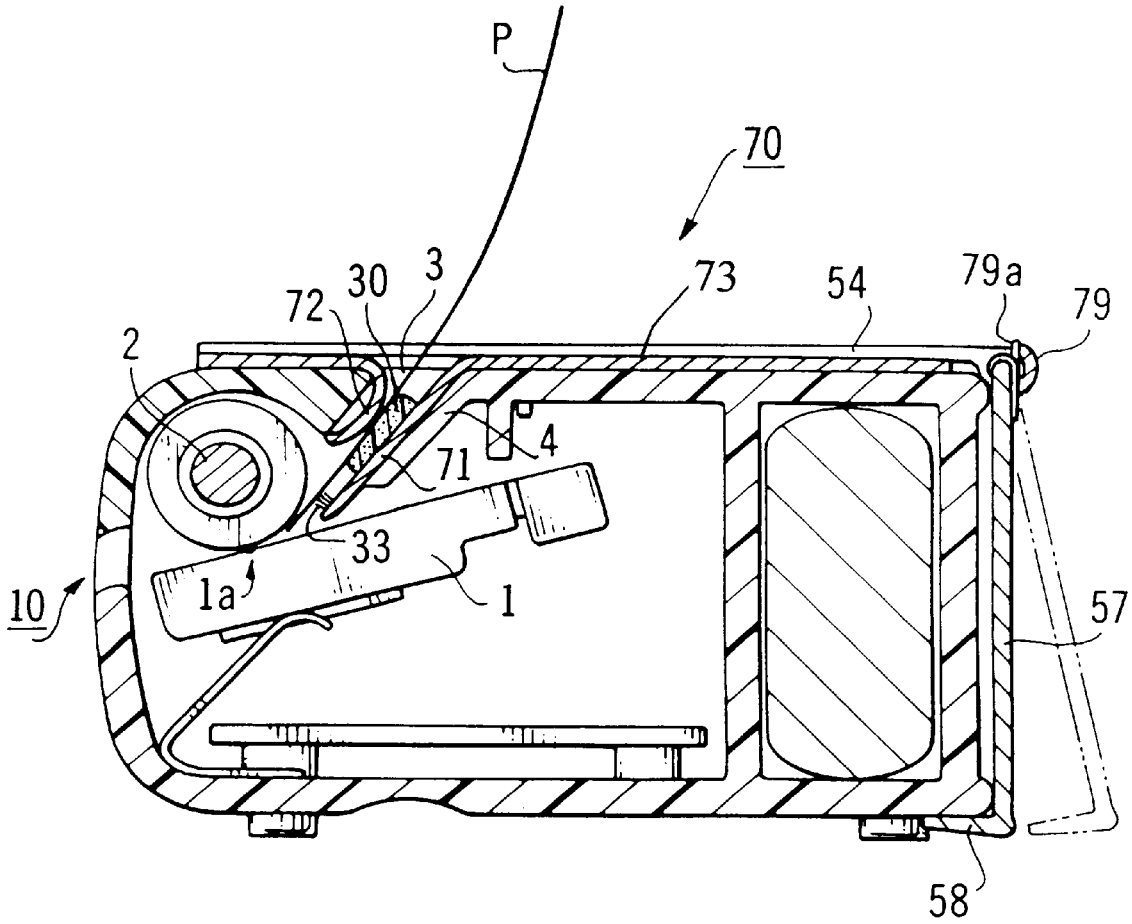
FIG. 5 is a sectional view of a thermal printer and a recording sheet cleaning apparatus according to a third embodiment the invention.

FIG. 5 is a sectional view of a recording sheet cleaning apparatus 70 according to the third embodiment. In the third embodiment, the recording sheet cleaning apparatus 70 is arranged so that the wiping member 30 is positioned inside the printer 10.

A base sheet 73 is provided with a first guide member 71 that extends from the rear (the right side in the drawing) of the upper part of the printer 10, bends into the inlet slot 3, and extends along the slope 4 to the vicinity of the thermal head 1. The base sheet 73 is further provided with a second guide member 72 that extends from the front of the printer (the left side in the drawing) and bends into the printer 10 at the front edge of the inlet slot 3 to form a curved surface. The wiping member 30 is fixed to a portion of the first guide member 71 that is inside the inlet slot 3. The wiping member 30 is positioned to face the printing surface of the recording sheet P. The wiping member 30 is placed in contact with the second guide member 72.

The recording sheet P passes between the wiping member 30 and the second guide member 72. The printing surface of the recording sheet P is pressed against the wiping member 30 by the elasticity of the second guide member 72 with sufficient force to wipe away debris.

With the recording sheet cleaning apparatus 70 according to the third embodiment, since the wiping member 30 is positioned in the vicinity of the thermal head 1, there is less chance that debris in the air will adhere to the recording sheet P after the wiping is completed. Furthermore, since the recording sheet cleaning apparatus 70 opens in the direction in which the recording sheet P is fed, it is easy to insert the recording sheet P into the printer 10. Still, furthermore, since the wiping member 30 is located within the casing 6 of the printer 10, the size of the printer 10 (with recording sheet cleaning apparatus 70 attached) is not increased.

A charge removing brush 33 is provided adjacent to the wiping member 30 to remove any undesirable charge caused by friction with the wiping member 30 so that the recording sheet P does not attract dust and dirt inside the printer 10.

In the recording sheet cleaning apparatus 70, since the first guide member 71 and the second guide member 72 protrude into the printer, it is slightly more difficult to fit the recording sheet cleaning apparatus 70 to the printer 10 from the rear side thereof. Accordingly, as shown in FIG. 5, the stopper section 59 of the previous two embodiments is replaced with a stopper section 79 that is shaped so that the clamping member 57 is rotatable with respect to the mounting frame 54 through a predetermined angle that is greater than 90 degrees (for example, 110 degrees). Further, a coil spring 79*a* is provided between the clamping member 57 and the mounting frame 54 such that, when the clamping member 57 is rotated beyond a 90 degree angle with respect to the mounting frame 54, the clamping member 57 is elastically pressed by the coil spring 79*a* to return to a position at which the clamping member 57 forms a 90 degree angle with respect to the mounting frame 54.

When attaching the recording sheet cleaning apparatus 70 to the printer 10, first, the clamping member 57 is rotated to an angle greater than 90 degrees by applying a force against the force to the coil spring 79*a*. Next, the recording sheet cleaning apparatus 70 is lowered toward the upper surface of the printer 10 from above rear thereof and the first guide member 71 and the second guide member 72 are introduced into the inlet slot 3. The base sheet 73 is settled onto the surface of the printer 10 and then the clamping member 57 is slowly released against the elastic force of the coil spring 57*a* to move (from the position shown by a phantom line in FIG. 5) toward the printer until the hook portion 58 is fit to a lower surface of the printer 10. The recording sheet cleaning apparatus 70 is thus attached to the printer 10.

Figure 6:
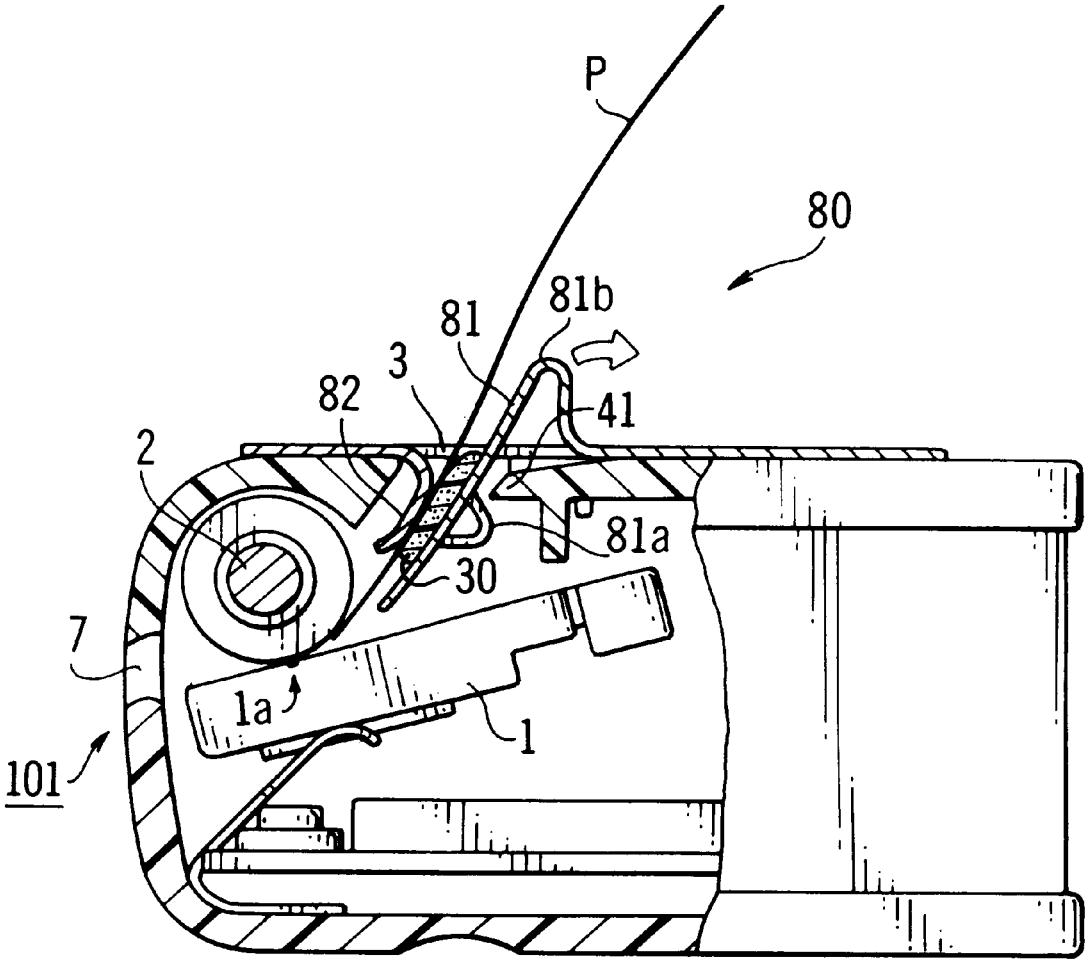
FIG. 6 is a sectional view of a thermal printer and a recording sheet cleaning apparatus according to a fourth embodiment of the invention.

FIG. 6 is a sectional view of a printer 101 and a recording sheet cleaning apparatus 70 according the fourth embodiment. In the fourth embodiment, the printer 101 is substantially the same as the printer 10 of the previous embodiment, except that the slope 41 thereof is comparatively short in the feeding direction.

The recording sheet cleaning apparatus 80 is arranged so that the wiping member 30 is located within the printer 10. A base sheet 83 is provided with a first guide member 81 that extends from the rear (the right side in the drawing) of the printer 101, is bent upright just prior to the inlet slot 3 and then bent back down to extend into the inlet slot 3 toward the thermal head 1. In this way, a raised lip 81*b* is formed at the edge of the inlet slot 3. The first guide member 81 is further provided with a projection 81*a,* extending substantially rearward from the portion of the first guide member 81 that is inserted into the inlet slot 3. The projection 81*a* is arranged to engage with an end of the slope 4 of the printer 101 when the recording sheet cleaning apparatus 80 is attached to the printer 101.

The wiping member 30 is attached to the first guide 10 member 81 at a predetermined position inside the printer 101. Further, similar to the previous embodiment, the base sheet 83 is also provided with a second guide member 82 that extends from the front of the printer (the left side in the drawing) and is bent into the printer 101 at the front edge of the inlet slot 3 to form a curved surface that is in contact with the wiping member 30.

Figure 7:
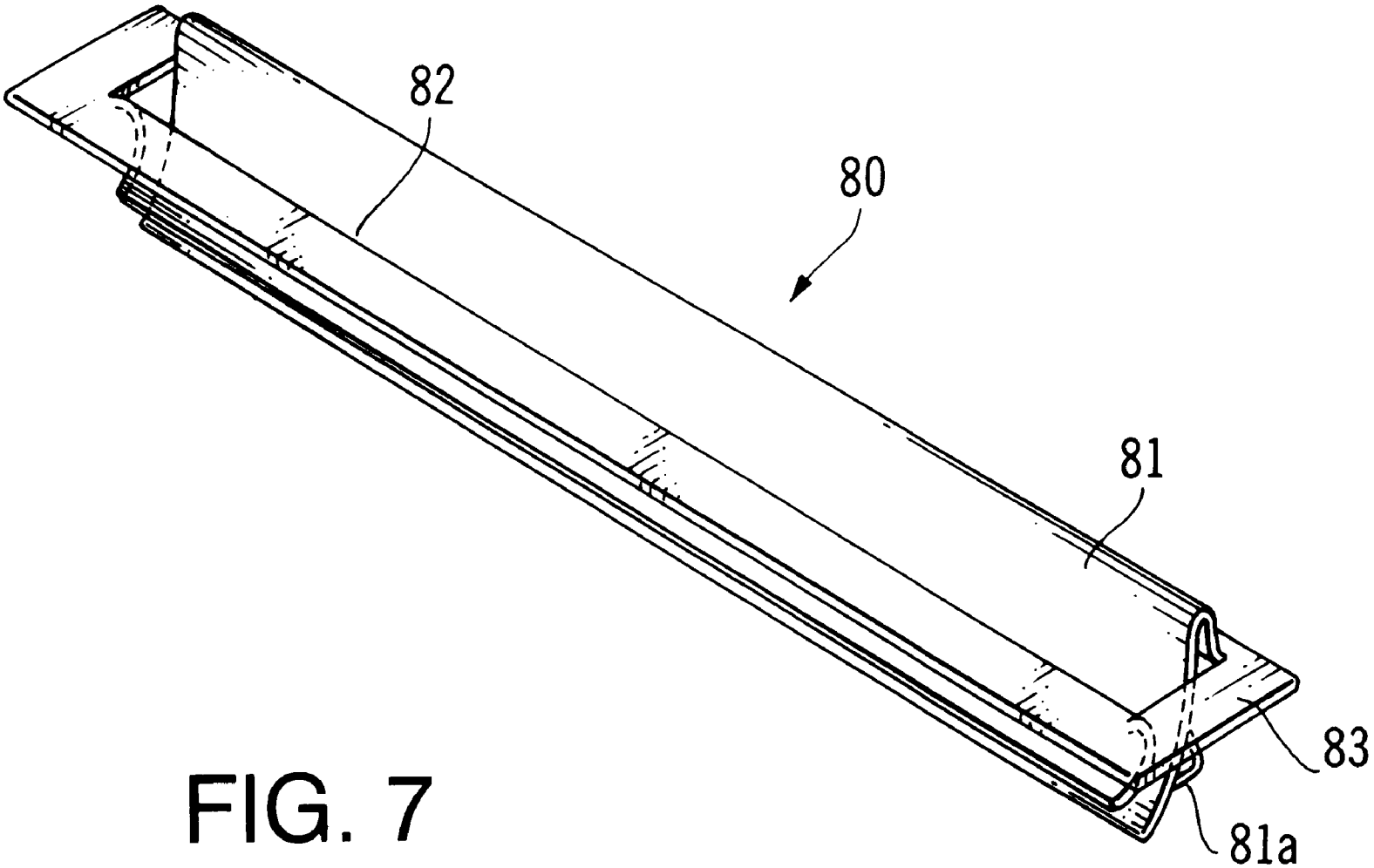
FIG. 7 is a perspective view of the recording sheet cleaning apparatus shown in FIG. 6.

FIG. 7 shows a perspective view of the recording sheet cleaning apparatus 80 (the wiping member 30 is not shown).

As shown in FIG. 7, the recording sheet cleaning apparatus 80 may be formed integrally, using, for example, a synthetic resin or the like.

The recording sheet cleaning apparatus 80 is attached to the printer 10 from the upper rear. First, the first and second guide members 81 and 82 are introduced into the inlet slot 3. The first guide member 81 is elastically deformed as the projection 81*a* passes over the slope 4. When the projection 81*a* reaches the end of the slope 4, the first guide member 81 returns to a neutral state and the projection 81*a* is engaged with the slope 4 such that the recording sheet cleaning apparatus 80 is securely attached to the printer 10.

The recording sheet cleaning apparatus 80 is removed from the printer 10 by pushing the lip 81*b* rearward (in the direction of the arrow in FIG. 6) until the projection 81*a* is disengaged from the slope 4, at which point the recording sheet cleaning apparatus 80 may be slid from the printer 10.

Thus, with the recording sheet cleaning apparatus 80 according to the fourth embodiment, it is not necessary to provide additional mounting members. Therefore, the construction of the apparatus is remarkably simplified. Furthermore, since only the bent part of the first guide member protrudes outside the printer 10 in a state where the attachment is mounted in a printer 10, the entire printer is made compact.

Furthermore, although not shown in FIGS. 6 and 7, a charge removing brush may be provided below the wiping member 30, as in the previous embodiments, in order to prevent debris from adhering to the recording sheet P due to undesirable charge.

The present disclosure relates to subject matter contained in Japanese Patent Application No. HEI 08-99450, filed on Mar. 28, 1996, which is expressly incorporated herein by reference in its entirety.

What is claimed is:

1. A recording sheet cleaning apparatus mounted to a thermal printer, said thermal printer having an inlet opening, a thermal head and a sheet feeding path for feeding recording sheets past said inlet opening and said thermal head, said apparatus comprising:

an array of heat generating elements in the thermal head, a wiping member made of polyurethane foam, said wiping member having a same length as said array;

a first guide member, said wiping member attached to said first guide member upstream of said thermal head along said sheet feeding path, said wiping member and said thermal head being on a same side with respect to said sheet feeding path;

a second guide member for pressing said recording sheet against said wiping member, so that said recording sheet contacts said wiping member, said first and second guide members comprising two sheet members facing each other, said two sheet members extending along said sheet feeding path, said first and second guide members extending from said inlet opening and outside of said printer;

a base member connected to said first and second guide members, said base member positioned on a housing of said printer, said first and second guide members being integral with said base member; and a mounting arrangement for detachably mounting said first and second guide members and said base member to said printer, said mounting arrangement including a frame to which said base member is fixed and a clamp member engagable with said housing of said printer.

2. The recording sheet cleaning apparatus according to claim 1, further comprising a third guide member which extends into the interior of said printer through said inlet opening such that said third guide member and said thermal head are on the same side with respect to said sheet feeding path.

3. The recording sheet cleaning apparatus according to claim 1, wherein said first guide member has a charge removing brush located between said wiping member and said inlet opening.

4. A recording sheet cleaning apparatus having an inlet opening, a thermal head and a sheet feeding path for feeding recording sheets past said inlet opening and said thermal head, comprising:

a wiping member;

a first guide member, said wiping member attached to said first guide member upstream of said thermal head along said sheet feeding path, said wiping member and said thermal head being on a same side with respect to said sheet feeding path, said first guide member having a charge removing brush located between said wiping member and said thermal head;

a second guide member for pressing said recording sheet against said wiping member, so that said recording sheet contacts said wiping member;

a base member for supporting said first and second guide members, said base member positionable on a housing of said printer; and a mounting arrangement for detachably mounting said first and second guide members to said printer, wherein said first and second guide members extend into an interior of said printer through said inlet opening, along said sheet feeding path.

5. A printer system comprising:

an inlet opening for inserting a recording sheet into said printer;

a thermal line head including an array of heat generating elements;

a sheet feeding path for feeding said recording sheet past said inlet opening and said thermal line head;

a wiping member having a same length as said array;

a first guide member, said wiping member attached to said first guide member upstream of said thermal head along said sheet feeding path, said wiping member and said thermal head being on the same side with respect to said sheet feeding path;

a second guide member for pressing said recording sheet towards said wiping member, so that said recording sheet is in contact with said wiping member, said first and second guide members being detachable from said printer; and a base member connected to said first and second guide members said base member being detachably attached to a housing of said printer, wherein said first and second guide members are made of two sheet members facing each other, said two sheet members extending along said sheet feeding path.

6. The printer system according to claim 5, wherein of first and second guide members extend apart from said inlet opening and outside of said printer.

7. The printer system according to claim 5, wherein said first and second guide members extend into an interior of said printer through said inlet opening, along said sheet feeding path.

8. A recording sheet cleaning apparatus having an inlet opening, a thermal head and a sheet feeding path for feeding recording sheets past said inlet opening and said thermal head, comprising:

a first guide member having an engaging member engagable with said inlet opening of said printer from the interior of said printer, the engagement of said engaging member and said inlet opening being disengaged by deforming said first guide member;

a wiping member, said wiping member attached to said first guide member upstream of said thermal head along said sheet feeding path, said wiping member and said thermal head being on a same side with respect to said sheet feeding path;

a second guide member for pressing said recording sheet against said wiping member, so that said recording sheet contacts said wiping member, said first and second guide members extending into an interior of said printer through said inlet opening, along said sheet feeding path;

a base member for supporting said first and second guide members, said base member positionable on a housing of said printer; and a mounting arrangement for detachably mounting said first and second guide members to said printer.

* * * * *